US006516520B1

(12) United States Patent
Liao

(10) Patent No.: US 6,516,520 B1
(45) Date of Patent: Feb. 11, 2003

(54) MULTI-FUNCTIONAL CUTTER

(76) Inventor: Sheng Hsin Liao, No. 10, Alley 38, Lane 229, San Chun St., Shulin, Taipei Hsien (TW)

( * ) Notice: Subject to any disclaimer, the term of this patent is extended or adjusted under 35 U.S.C. 154(b) by 0 days.

(21) Appl. No.: 09/917,716

(22) Filed: Jul. 31, 2001

(51) Int. Cl.[7] ..... B26B 1/08
(52) U.S. Cl. ..... 30/162; 30/294
(58) Field of Search ..... 30/142, 143, 162, 30/286, 289, 294, 278; 7/160

(56) References Cited

U.S. PATENT DOCUMENTS 2,870,537 A * 1/1959 Ortner ..... 30/162
4,803,782 A * 2/1989 Lok ..... 30/294
5,555,624 A * 9/1996 McCracken ..... 30/294
5,581,890 A * 12/1996 Schmidt ..... 30/162
5,890,290 A * 4/1999 Davis ..... 30/162

* cited by examiner

*Primary Examiner*—Hwei-Siu Payer
(74) *Attorney, Agent, or Firm*—Rosenberg, Klein & Lee

(57) ABSTRACT

A multi-functional cutter comprises a casing formed with a sliding groove; a control unit slidably installed in the sliding groove of the casing; a knife installed within the casing and being connected to the control unit; a guiding unit firmly secured to the casing and the knife being inserted into the guiding unit; and an elastic element installed between the casing and the control unit for providing a force for restoring the control unit and the knife. The user may push the control unit to drive one end of the knife to protrude out to cut an object so that the present invention is used as a small knife. Furthermore, an envelope can be placed within the guiding unit and another end of the knife inserted into the guiding unit is used to cut the sealed opening of an envelope so as to provide the function of cutting an envelope.

8 Claims, 7 Drawing Sheets

MULTI-FUNCTIONAL CUTTER

FIELD OF THE INVENTION

The present invention relates to a multi-functional cutter having both functions of a small knife and cutting an envelope so as to occupy only a small space to be carried easily and conveniently.

BACKGROUND OF THE INVENTION

The prior art small knife is used in the business affairs, which has a thin knife piece and is suitable to cut papers, cloths, films, plastics, rubbers etc. Other functions, such as cutting an envelope, has not been provided. The application is narrow and can not be utilized widely.

A commercial envelope cutter is used for cut the sealing opening of an envelope, but it has only such a function (such as aforesaid small knife). Thus the application is still narrow, and can not be used widely.

Therefore, if one is desired to use a small knife and an envelope cutter, the user must prepare the two devices. Not only the economic burden is heavy, but also a large space is necessary to store the two devices so as to carry and store the two are inconvenient.

SUMMARY OF THE INVENTION

Accordingly, the primary object of the present invention is to provide a multi-functional cutter having both functions of a small knife and cutting an envelope which are commonly used an identical knife, thereby the whole structure being simple. The user is unnecessary to both a small knife and an envelope cutter. Not only the economic burden is reduced, but also the small knife and envelope cutter are combined as an integral body so as to occupy only a small space to be carried easily and conveniently.

To achieve above object, the present invention provides a multi-functional cutter comprises a casing, a control unit, a knife, a guiding unit, an elastic element. The casing is formed with a sliding groove. The control unit is slidably installed in the sliding groove of the casing. The knife is installed within the casing and is connected to the control unit. The guiding unit is firmly secured to the casing and the knife being inserted into the guiding unit. An elastic element is installed connected the casing and the control unit for providing a force for restoring the control unit and the knife. The user may push the control unit to drive one end of the knife to protrude out to cut an object as that the present invention is used as a small knife. Furthermore, an envelope can be placed within the guiding unit and another end of the knife inserted into the guiding unit is used to cut the sealed opening of an envelope so as to provide the function of cutting an envelope.

The various objects and advantages of the present invention will be more readily understood from the following detailed description when read in conjunction with the appended drawing.

DETAILED DESCRIPTION OF THE PREFERRED EMBODIMENTS

Figure 1:
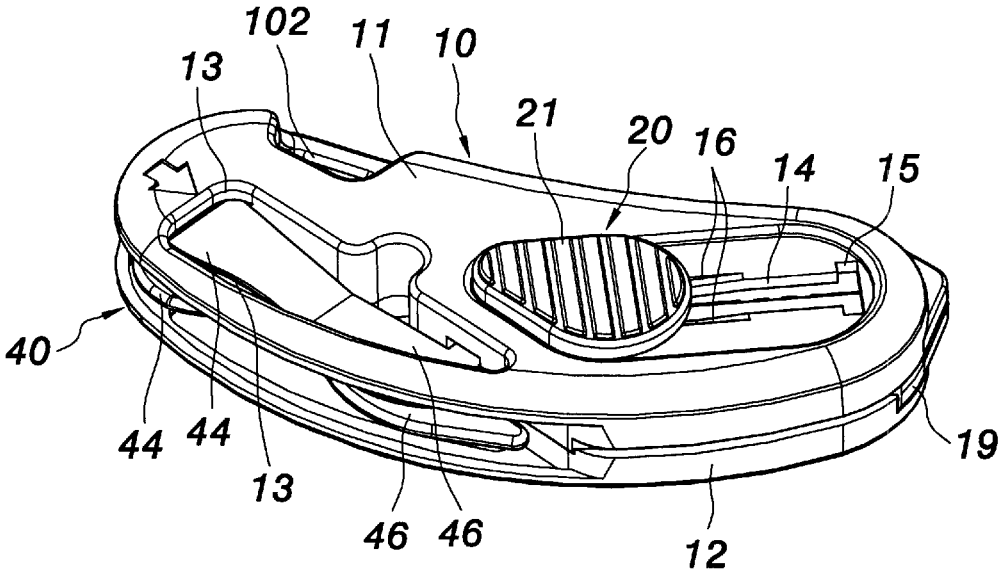
FIG. 1 is an assembled perspective view of the present invention.
Figure 2:
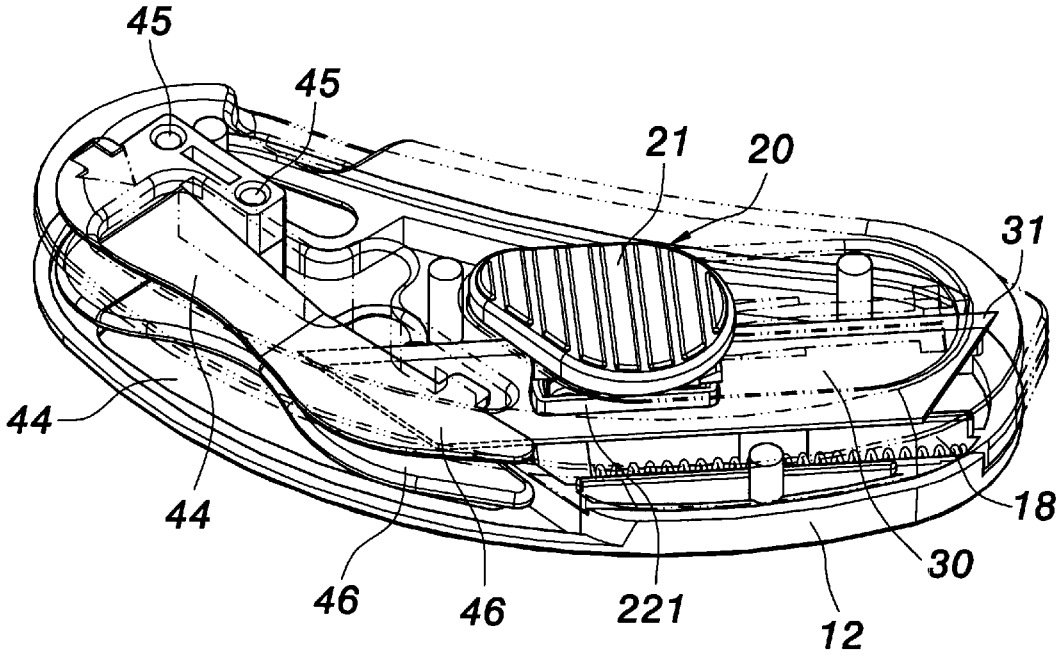
FIG. 2 is a schematic perspective view of the interior structure of the present invention.
Figure 3:
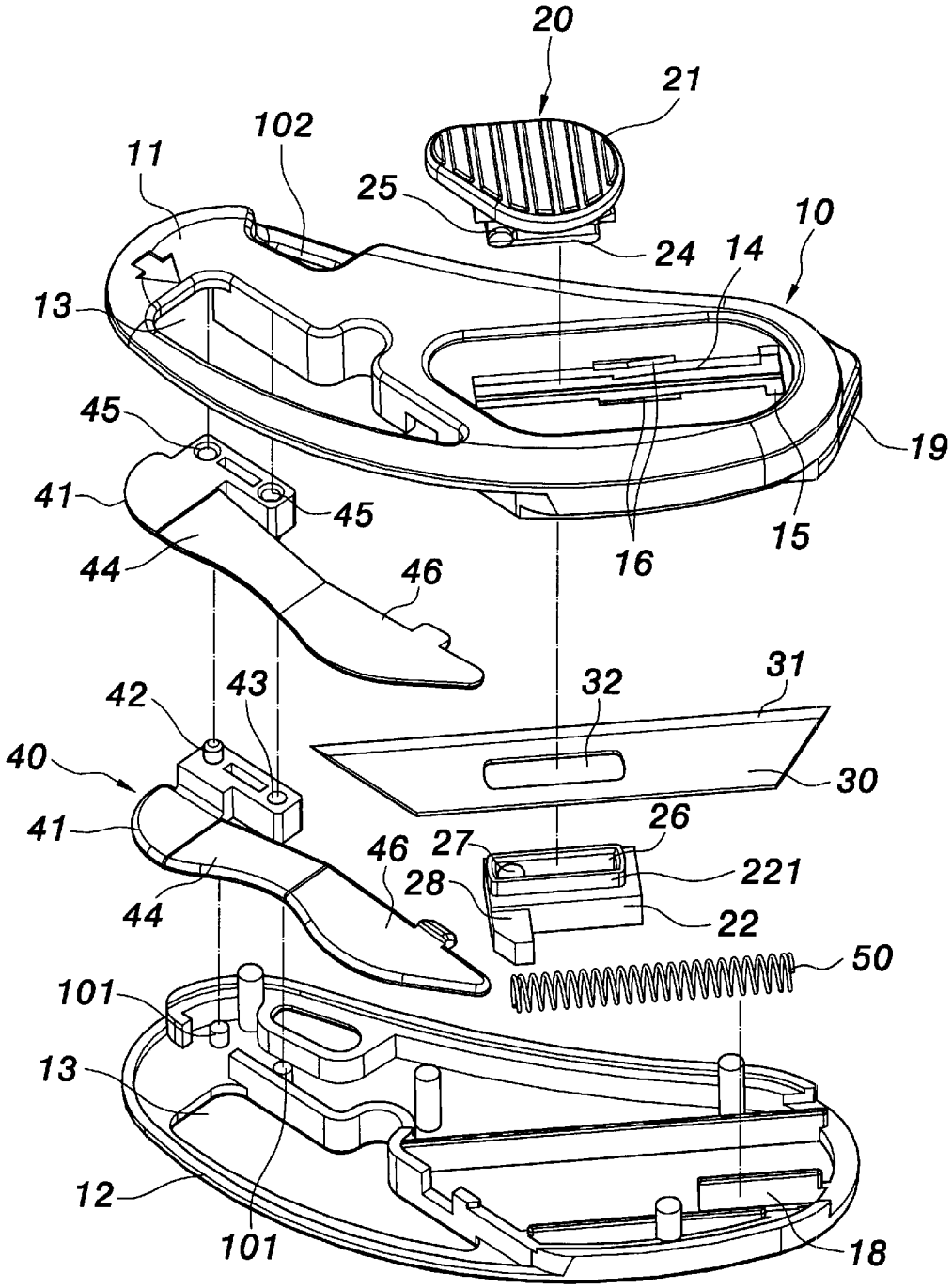
FIG. 3 is an exploded perspective view of the present invention.
Figure 4:
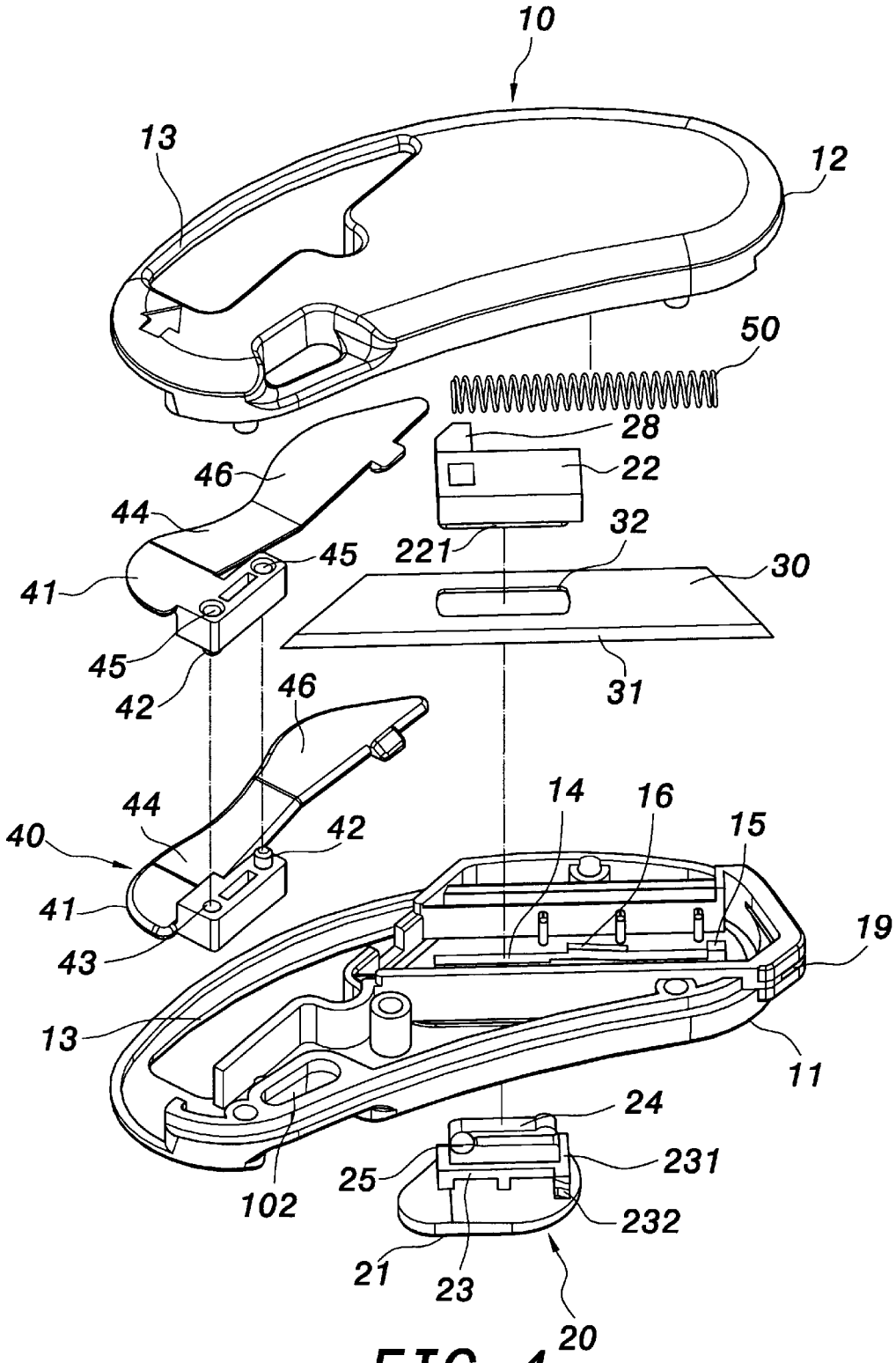
FIG. 4 is an exploded perspective view showing another view of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 5, the multi-functional cutter of the present invention is illustrated. The multi-functional cutter of the present invention includes a casing 10, a control unit 20, a knife 30, a guiding unit 40 and an elastic element 50. The casing 10 is formed by a first casing half 11 and a second casing half 12 which are combined by buckling or screwing. The first casing half 11 and second casing half 12 are provided with respective guiding unit receiving groove 13. The first casing half 11 has a sliding groove 14. The sliding groove 14 extends from the first casing half 11 to a near end. A front end of the sliding groove 14 is formed with a front positioning groove 15. The two sides at the middle section of the sliding groove 14 are provided with tilt guiding surfaces 16, respectively. A rear positioning block 17 and an elastic element receiving groove 18 are formed at the first casing half 11. The casing 10 can be provided with a key hole 102 for being connected to a key ring and the a magnet (not shown) is provided on the casing 10, thereby cutter can be absorbed to an iron material.

The control unit 20 is slidably installed to the casing 10 and is formed by a pushing button 21 and a driven piece 22. The bottom of the pushing button 21 is connected to a sliding block 23. The front end of the sliding block 23 is connected to a front positioning portion 231 with respect to the front positioning groove 15. The two sides of the front positioning portion 231 are provided with buckling blocks 232. The bottom of the sliding block 23 is connected to an elastic arm 24. One end of the elastic arm 24 is formed as a free end, and another end thereof is provided with a pivotal shaft 25. The pushing button 21 is slidably matched to the sliding groove 14 of the casing 10 by the sliding block 23 at the bottom thereof. The elastic arm 24 of the sliding block 23 is inserted into the casing 10. The driven piece 22 is movably matched to the interior of the casing 10. A receiving groove 26 is formed on the driven piece 22. The sliding block 23 and the elastic arm 24 are matched to the receiving groove 26. Two sides of the interior of the receiving groove 26 are formed with pivotal holes 27 for being pivotally engaged with the pivotal shafts 25 so that the pushing button 21 and the driven piece 22 are pivotally connected. One side of the driven piece 22 is provided with a protrusion 28.

The knife 30 is a thin knife and has a sharp edge 31. The knife 30 is provided with an assembling hole 32. The knife 30 is provided in the casing 10 and the assembling hole 32 is engaged with the protruded portion 221 at a top of the driven piece 22 so that the knife 30 is connected to the control unit 20. The knife 30 is driven by the control unit 20 so as to slide on the casing 10. One end of the casing 10 is formed with a hole 19, thereby, one end of the knife 30 protruding out therefrom (referring to FIG. 6).

The guiding unit 40 is formed by two guiding plates 41 which are matched to one another. The two guiding plates 41 are provided with respective buckles 42 and buckling holes 43, respectively. The two guiding plates 41 can be engaged by the buckles 42 and buckling holes 43. A gap is formed between the two bottom plates 41 for being passing through by envelopes or other objects to be cut. One end of each bottom plate 41 is formed with a tilt guiding-in portion 44 which are reduced gradually. Another end of the guiding plate 41 is formed with a tilt guiding-out portion 46. The two guiding-out portions 46 are expanded gradually. The two guiding plates 41 are provided in the two guiding unit receiving grooves 13 of the casing 10. Each guiding plate 41 is further provided with a buckling hole 45. The casing 10 is provided with respective buckle 101. The buckling hole 45 and the buckle 101 are engagable, thereby the guiding unit 40 formed by the two guiding plates 41 being firmly secured to the casing 10. Another end of the knife 30 is inserted into the place between the two guiding plates 41 of the guiding unit 40.

The elastic element 50 is provided a compressible spring, and is received in the elastic element receiving groove 18 of the casing 10. One end of the elastic element 50 resists against the inner wall of the casing 10. Another end thereof resists against the protrusion 28 of the driven piece 22. Therefore, the elastic element 50 provides a restoring force to the control unit 20 and the knife 30 so as to drive the knife 30 to retract into the interior of the casing 10. Therefore, the multi-functional cutter of the present invention is formed by above components.

Figure 6:
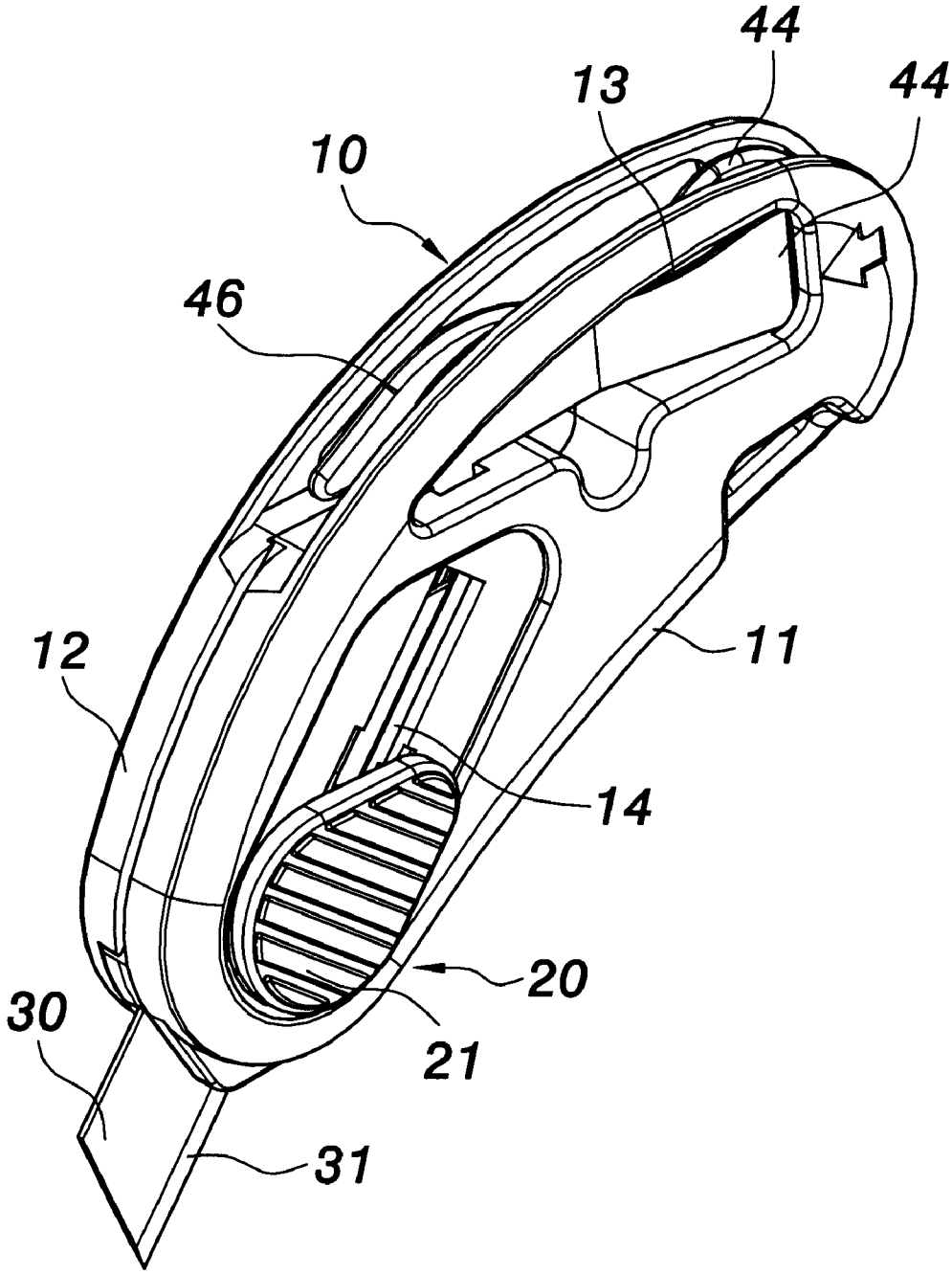
FIG. 6 is a schematic view showing the application of the present invention.

With reference to FIG. 6, the present invention has a function like a small knife. The user may press the pushing button 21 of the control unit 20 and the pushing button 21 is pushed out. By the pushing button 21 and the driven piece 22 to drive one end of the knife 30 to protrude out, the knife 30 can be used to cut an object or as the pushing button 21 of the control unit 20 is pushed to an extreme end, a front positioning portion 231 of the sliding block 23 will conform to the front positioning groove 15 at the front end of the sliding groove 14 due to the pressure from the user's finger. Thereby, the protruding knife 30 can be positioned for cutting.

When the pushing button 21 is released, the pushing button 21 may displace upwards by the elastic force of the elastic arm 24 so that the front positioning portion 231 is separated from the front positioning groove 15. Then the elastic element 50 provides a restoring force to the control unit 20 so that the knife 30 is driven and then retracted into the casing 10.

Figure 5:
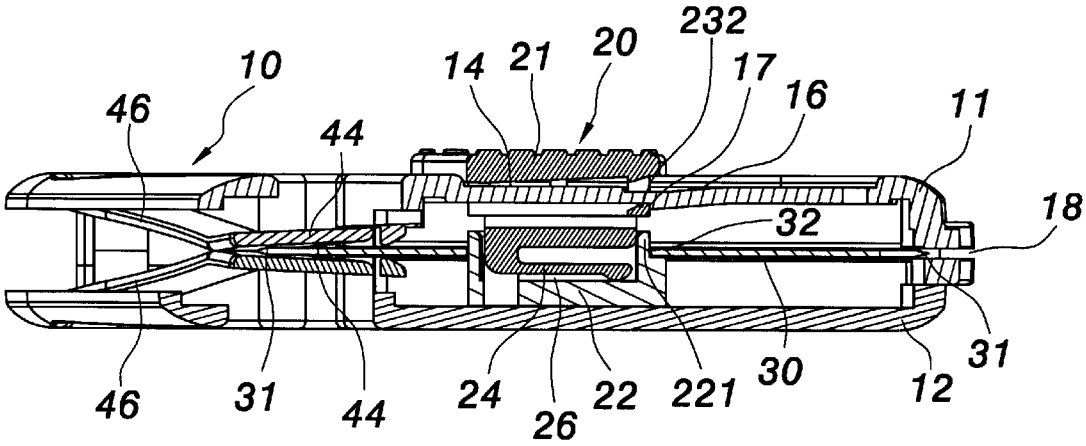
FIG. 5 is a cross sectional view of the present invention.
Figure 7:
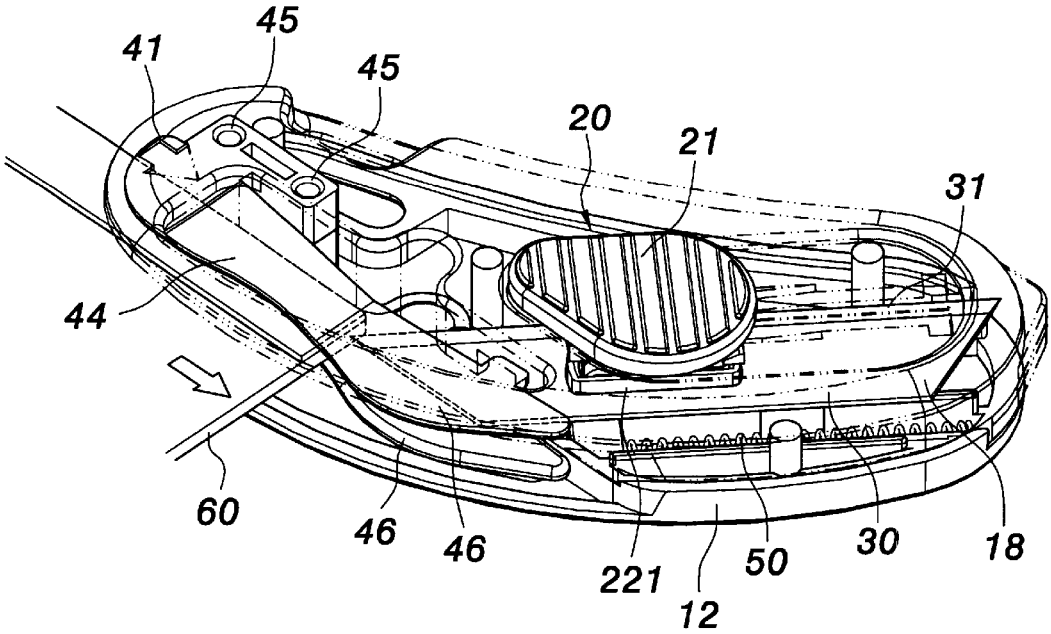
FIG. 7 is another schematic view showing the application of the present invention.

Referring to FIGS. 5 and 7, the present invention can be used to cut an envelope. When the control unit 20 drives the knife 30 so that it restores and retracts into the casing 10, the pushing button 21 of the control unit 20 will descend along the guiding surface 16 and the buckle 232 of the pushing button 21 resists against the positioning block 17, thereby providing a positioning function to the control unit 20 and the knife 30. Therefore, the envelope 60 is guided into the guiding unit 40 through the guiding-in portion 44 of the two guiding plates 41 and then another end of the knife 30 inserted into the place between the two guiding plates 41 is used to cut the sealing end of the envelope 60. Then the envelope 60 is guided out through the guiding-out portion 46 of the two guiding plates 41.

Therefore, the present invention has both functions of a small knife and cutting an envelope which are commonly used a knife 30, thereby the whole structure being simple. The user is unnecessary to buy a small knife and an envelope cutter. Not only the economic burden is reduced, but also the small knife and envelope cutter are combined as an integral body so as to occupy only a small space to be carried easily and conveniently.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multi-functional cutter comprising:

a casing formed with a sliding groove;

a control unit slidably installed in the sliding groove of the casing;

a knife installed within the casing and being connected to the control unit;

a guiding unit firmly secured to the casing and the knife being inserted into the guiding unit; and an elastic element installed between the casing and the control unit for providing a force for restoring the control unit and the knife, a front end of the sliding groove of the casing having a front positioning groove formed therein, two sides of a middle portion of the sliding groove having tilt guiding surfaces formed thereon, respectively, a rear positioning block being received within the casing, the control unit having a pushing button and a driven piece, the pushing button being connected to a sliding block, a front end of the sliding block being connected to a front positioning portion configured with respect to the front positioning groove, two sides of the front positioning portion having respective buckles formed thereon, the sliding block being connected to an elastic arm, two sides of one end of the elastic arm having respective pivotal shafts, the pushing button being slidably matched to the sliding groove of the casing, a receiving groove being installed in the driven piece, two sides of the interior of the receiving groove having pivotal holes formed therethrough for pivotal connection to the pivotal shafts, the knife having an assembling hole formed therethrough, the assembling hole engaging the driven piece, one end of the casing having a hole formed therethrough, one end of the knife projecting through the hole.

2. The multi-functional cutter as claimed in claim 1, wherein the casing is formed by a first casing half and a second casing half, and the sliding groove is installed in the first casing half.

3. The multi-functional cutter as claimed in claim 1, wherein the casing has a key hole formed therethrough.

4. The multi-functional cutter as claimed in claim 1, wherein the guiding unit is assembled or integrally formed to the casing.

5. A multi-functional cutter comprising:

a casing formed with a sliding groove;

a control unit slidably installed in the sliding groove of the casing;

a knife installed within the casing and being connected to the control unit;

a guiding unit firmly secured to the casing and the knife being inserted into the guiding unit; and an elastic element installed between the casing and the control unit for providing a force for restoring the control unit and the knife, the control unit having two guiding plates coupled by a buckling connection, a gap being formed between the two guiding plates, one end of each of the two guiding plates having a tilt guiding-in portion, the other end thereof being formed with a tilt guiding-out portion, the two guiding plates being fixed to the casing, one end of the knife being inserted between the two guiding plates of the guiding unit.

6. The multi-functional cutter as claimed in claim 5, wherein the casing is formed by a first casing half and a second casing half, and the sliding groove is installed in the first casing half.

7. The multi-functional cutter as claimed in claim 5, wherein the casing has a key hole formed therethrough.

8. The multi-functional cutter as claimed in claim 5, wherein the guiding unit is assembled or integrally formed to the casing.

* * * * *